United States Patent [19]

Vanaglash, Jr.

[11] 4,082,908

[45] Apr. 4, 1978

[54] GOLD PLATING PROCESS AND PRODUCT PRODUCED THEREBY

[75] Inventor: John J. Vanaglash, Jr., Tucson, Ariz.

[73] Assignee: Burr-Brown Research Corporation, Tucson, Ariz.

[21] Appl. No.: 683,337

[22] Filed: May 5, 1976

[51] Int. Cl.[2] ..... B32B 15/00; C22C 19/03

[52] U.S. Cl. ..... 428/672; 427/399; 427/437; 427/438; 427/383 D; 428/680; 106/1.27

[58] Field of Search ..... 427/383 D, 399, 405, 427/125, 436, 437, 438, 304, 305; 148/6.14 R; 106/1; 428/672, 680

[56] References Cited

U.S. PATENT DOCUMENTS

| | | | |
|---|---|---|---|
| 1,869,817 | 8/1932 | Ledig | 427/383 |
| 3,214,292 | 10/1965 | Edson | 427/436 |
| 3,266,929 | 8/1966 | Lareau et al. | 427/436 |
| 3,300,328 | 1/1967 | Luce | 427/437 |
| 3,468,676 | 9/1969 | Schneble et al. | 427/437 |
| 3,506,462 | 4/1970 | Oda et al. | 427/437 |
| 3,589,916 | 6/1971 | McCormack | 427/437 |
| 3,700,469 | 10/1972 | Okinaka | 427/437 |
| 3,917,885 | 11/1975 | Baker | 427/304 |
| 3,986,255 | 10/1976 | Mandal | 427/125 |

FOREIGN PATENT DOCUMENTS

| | | | |
|---|---|---|---|
| 45-15847 | 10/1966 | Japan | 427/383 |
| 33-7514 | 5/1965 | Japan. | |

*Primary Examiner*—Ronald H. Smith
*Attorney, Agent, or Firm*—Cahill, Sutton & Thomas

[57] ABSTRACT

An electroless gold plating process in which the workpiece to be plated has a nickel coating, the process resulting in formation of a nickel/gold alloy that exhibits the majority of the physical characteristics exhibited by pure gold plating.

11 Claims, No Drawings

GOLD PLATING PROCESS AND PRODUCT PRODUCED THEREBY

BACKGROUND OF THE INVENTION

This invention relates to metal plating. More particularly, it relates to a metal finish of a gold alloy and a method of plating to produce such finish.

Gold plating is currently accomplished by several techniques, including electrolytic plating, immersion plating, and autocatalytic plating (reduction of gold from gold solutions). Because of the rapid rise in gold prices, the plating industry is concentrating considerable effort in finding ways to produce metal finishes that exhibit the desirable properties of gold plating, including environmental aging, temperature and humidity cycling, handling, solderability, TC and ultrasonic weldability, cosmetic appearance and abrasion resistance. Among the substitute metal finishes which have been utilized are tin, nickel boron, tin nickel and tin lead films, to name a few. None of the foregoing have been found to substantially approximate the qualities of gold. Gold/nickel electroplating has also been employed, but such processes suffer from the disadvantage that control of the chemistry is difficult and electrical connection to the workpiece is required. Electroless gold alloy finishes have been prepared in an attempt to extend the amount of gold without sacrificing performance. For example, Japanese Pat. No. 33-7514, reports a gold-/nickel alloy having 1.5 times the anti-abrasion properties of gold. However, the nickel to gold ratio is relatively low, at best only 15-20%, and thus the goal of significant cost savings is eluded.

SUMMARY OF THE INVENTION

It is an object of this invention to provide a metal finish having a substantially reduced gold content which exhibits the major performance characteristics of a pure gold metal finish.

It is a further object to provide a process for producing such a metal finish which does not require the external application of electricity to the workpiece.

Another object is a process for producing such a metal finish which is relatively simple and easy to control.

These and other objects which will be apparent hereinafter are provided in one embodiment by a process comprising providing a workpiece having a metal finish comprising at least about 85% by weight nickel, hereinafter referred to as nickel base finish, and treating the workpiece with a plating bath containing (a) a plating source component comprising a monovalent gold compound, and (b) a buffering component, exemplary of which are ammonium bifluoride, sodium citrate, sodium bicarbonate/ammonium hydroxide, and water-soluble salts, particularly sodium and potassium salts of carboxylic acids. The gold based finish is an alloy comprising gold and nickel in which the molecular ratio of nickel to gold is between 1:1 and 6:1.

The nickel based finish occurring on the substrate or workpiece may be produced by conventional plating techniques for nickel and nickel alloys. The nickel based finish may be pure nickel (99.99% pure) or nickel alloyed or combined with other elements such as cobalt, boron, and phosphorus. Preferably the nickel is present to the extent of at least 85% by weight. Phosphorus has been found to inhibit the plating of gold and reduce the temperature stability of the gold based finish. For certain uses, however, the presence of phosphorus can be tolerated, but should preferably not exceed 6% by weight of the nickel based finish. Typical nickel based finishes include nickel (99.99%), nickel/cobalt/phosphorus (85/10/5 by weight, respectively), nickel/phosphorus (95/5 by weight, respectively), and nickel/boron (99/1 by weight, respectively). Typically the nickel based finish is relatively uniform in thickness, being between 100 and 150 microinches (250-375 microcentimeters) thick.

A typical bath for obtaining a nickel/phosphorus metal finish contains nickel chloride, sodium citrate, ammonium bifluoride, and sodium hypophosphate. Substituting dimethyl amine borane for sodium hypophosphate yields a nickel/boron metal finish. The addition of nickel cobalt will introduce cobalt into the nickel based finish. The workpiece on which the nickel based finish is applied may be nickel, copper, nickel/steel, or any other substrate capable of being nickel plated.

After providing the workpiece with the nickel based finish, the workpiece is prepared for the gold plating bath. A typical preparation involves degreasing the surface by washing with a suitable solvent such as methylene chloride, rinsing with an acid solution followed by extensive water rinsing, and treatment with a solution of potassium cyanide containing hydrogen peroxide, followed by rinsing in deionized water. The prepared workpiece is then ready for the plating bath, which has been previously prepared. The plating component of the bath is one or more water soluble monovalent gold compounds, exemplary of which are potassium gold cyanide, gold chloride, and gold citrate. A buffering component is also part of the bath. Suitable buffering agents include a mixture of sodium bicarbonate and ammonium hydroxide, ammonium bifluoride, ammonium citrate, and salts of carboxylic acid. The buffering component is added to the solution of the plating component, care being taken to avoid inhalation of hydrogen cyanide which may be produced with certain mixtures. The precise role assumed by the buffering component is not fully understood. It is theorized that in addition to serving as a buffer the agent may also combine with the nickel in the nickel based layer to form a complex soluble in the gold plating bath.

The workpiece to be plated is immersed in the bath maintained at a constant temperature, preferably about 90° to 95° C. Agitation is initially vigorous, and then reduced for the plating period. After completion of the plating process, the plated workpiece is rinsed. The process has resulted in gold based metal finishes 100 or more microinches (250 microcentimeters) thick. The gold based metal finish is an alloy containing nickel and gold in which the molecular ratio of nickel to gold is from 1:1 to 6:1.

The gold based finish exhibits the physical characteristics of pure gold plating with the exception of resistance to salt spray and nitric acid according to standard test procedures. The finish is slightly yellowish with high brightness of nickel platetone and is of high corrosion and anti-abrasion qualities.

The plating component of the bath should be present in an amount sufficient to achieve the desired thickness of plating. Generally, the plating component is present to the extent of at least three grams per liter of bath. The buffering component is present to the extent of at least about 75 grams per liter and generally 100 grams per liter or more. The plating may take place in any suitable container. A preferred container has an inner tank lined with an inert material surrounded by a jacket through which circulates fluid to heat the bath. In terms of the surface to be plated, it is desirable that the gold plating compound be present to the extent of about 1 to 10, preferably 2 to 8 times $10^{-5}$ moles per liter per square inch to be plated. The buffering component may be present to the extent of about $3\times10-4$ to $4\times10-3$ moles per liter per square inch to be plated.

The following examples are provided to further illustrate the invention.

EXAMPLE I

A bath is prepared consisting of the following:

| Ingredient | Concentration (grams/liter) |
|---|---|
| Plating Component | |
| Potassium gold cyanide | 3 |
| Buffering Component | |
| Sodium bicarbonate | 100 |
| Ammonium hydroxide | 15 |
| Water, balance to make 1.0 liter | |

The plating component is prepared by dissolving the potassium gold cyanide in deionized water. The buffering component is prepared by adding the sodium bicarbonate and ammonium hydroxide to the plating component solution. Sufficient deionized water is then added to make one liter of bath solution.

The workpiece, which has a pure nickel surface 150 microinches (375 microcentimeters) thick, is subjected to a cleaning and activation process prior to plating. The nickel based finish is washed with methylene chloride to degrease the nickel. The degreased workpiece is then rinsed in a 120° F. solution of 50% HCl for 1 to 5 seconds after gassing starts followed by cold water rinsing for several minutes. The nickel coated workpiece is then placed in a solution of 10 grams/liter KCN and 50 ml./liter $H_2O_2$ and the solution agitated for ten minutes. The workpiece is removed from the solution, rinsed with deionized water, and placed in the plating bath.

The plating bath is preheated to 90° to 95° C. After placing the cleaned, nickel coated workpiece in the bath, the solution is agitated for one minute, and then occasionally for several minutes. The workpiece is removed and rinsed with tap water for several minutes followed by a rinse with deionized water. A gold plated finish is produced 60 microinches (150 microcentimeters) thick having a nickel/gold molecular ratio of 6:1.

EXAMPLES II and III

The procedure of Example I except that baths of the following formulations are employed. In each case, a nickel/gold alloy metal finish is produced.

EXAMPLE II

| Ingredient | Concentration (grams/liters) |
|---|---|
| Plating Component | |
| $KAu(CN)_2$ | 6 |
| Buffer Component | |
| Ammonium bifluoride | 100 |

EXAMPLE III

| Ingredient | Concentration (grams/liters) |
|---|---|
| Plating Component | |
| $KAu(CN)_2$ | 3 |
| Buffer Component | |
| Ammonium citrate | 100 |

-continued

| Ingredient | Concentration (grams/liters) |
|---|---|
| Water, balance to make 1 liter | |

The gold plated finish is an alloy of nickel and gold and such other elements as may be present in the nickel based finish, e.g., cobalt, boron, and phosphorus. The gold/nickel alloy wherein the nickel based finish is substantially pure nickel (99.99%) provides a high temperature stable (at least 450° C.) gold alloy. The presence of phosphorus in the nickel based finish results in a gold based finish which deteriorates at a temperature of 300° C. and above.

The mechanism by which the gold based finish is produced is not completely understood. The deep penetration of the gold appears to rule out the conventional immersion mechanism. It appears rather that the nickel based finish is removed to a substantial depth, and passes into the gold plating bath, where it is alloyed with gold, and redeposited on the workpiece. The gold based finish is uniform, strongly adherent to the base, and preferably at least 15 microinches (37.5 microcentimeters) thick. Thickness of 60 to 100 microinches or more have been achieved.

What is claimed is:

1. A metal plating process independent of application of electrical power to the workpiece comprising the steps of:

a. providing a workpiece having a nickel based finish, said finish being at least 85% by weight nickel; and b. treating said workpiece with a bath comprising a plating source component and a buffering component, said plating source component comprising one or more gold containing compounds wherein said gold is capable of alloying with said nickel of said nickel based finish, said treating being conducted for a time and at a temperature sufficient to provide a layer on said workpiece, said layer comprising an alloy of nickel and gold, said layer having a molecular ratio of nickel to gold of from 1:1 to 6:1, and wherein the source of said nickel in said layer is the nickel from said nickel based finish.

2. The process of claim 1 wherein said nickel is at least 99% by weight pure.

3. The process of claim 1 wherein said bath is an aqueous bath.

4. The process of claim 1 wherein said gold containing compound is a monovalent gold compound.

5. The process of claim 1 wherein at least one of said gold containing compounds is potassium gold cyanide.

6. The process of claim 1 wherein said gold containing compound is present to the extent of about $1 \times 10^{-5}$ to $10 \times 10^{-5}$ moles per liter per square inch of surface of said nickel based finish and said buffering compound is present to the extent of about $3 \times 10^{-4}$ to $4 \times 10^{-3}$ moles per liter per square inch of surface of said nickel based finish.

7. The process of claim 1 wherein said buffering component comprises at least one member of the group consisting of a mixture of sodium bicarbonate and ammonium hydroxide, ammonium bifluoride, and a water soluble salt of a carboxylic acid.

8. The process of claim 1 wherein said nickel based finish comprises nickel and at least one member of the group consisting of cobalt, boron, and phosphorus, provided that said phosphorus does not exceed about 6% by weight.

9. The process of claim 1 wherein said buffering component forms a water soluble nickel complex.

10. A workpiece having a nickel based finish treated in accordance with the process of claim 1.

11. A workpiece having a nickel based finish treated in accordance with the process of claim 8.

* * * * *